US010051701B2

(12) United States Patent
Williams et al.

(10) Patent No.: US 10,051,701 B2
(45) Date of Patent: Aug. 14, 2018

(54) SYSTEMS AND METHODS FOR MAINTAINING DIMMER BEHAVIOR IN A LOW-POWER LAMP ASSEMBLY

(71) Applicant: PHILIPS LIGHTING HOLDING B.V., Eindhoven (NL)

(72) Inventors: Jonathan Williams, Austin, TX (US); Ananthakrishnan Viswanathan, Austin, TX (US); John L. Melanson, Austin, TX (US); August Laible, Austin, TX (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 471 days.

(21) Appl. No.: 14/332,931

(22) Filed: Jul. 16, 2014

(65) Prior Publication Data

US 2016/0021714 A1 Jan. 21, 2016

(51) Int. Cl.
*H05B 33/08* (2006.01)
*H05B 35/00* (2006.01)

(52) U.S. Cl.
CPC ..... *H05B 33/0845* (2013.01); *H05B 35/00* (2013.01)

(58) Field of Classification Search
CPC . H05B 33/08; H05B 33/0803; H05B 33/0806
See application file for complete search history.

(56) References Cited

U.S. PATENT DOCUMENTS

| | | | |
|---|---|---|---|
| 4,334,250 | A | 6/1982 | Theus |
| 4,979,087 | A | 12/1990 | Sellwood et al. |
| 5,206,540 | A | 4/1993 | de Sa e Silva et al. |
| 5,781,040 | A | 7/1998 | Myers |

(Continued)

FOREIGN PATENT DOCUMENTS

| | | | |
|---|---|---|---|
| CN | 201177180 | Y | 1/2009 |
| DE | 2262273 | A | 6/1993 |

(Continued)

OTHER PUBLICATIONS

Dunn, Jamie, Determining MOSFET Driver Needs for Motor Drive Applications, 2005, pp. 1-18, Microchip Technology, Chandler, AZ.

(Continued)

*Primary Examiner* — Jason M Crawford

(57) ABSTRACT

In accordance with the present disclosure, a control circuit may be employed for controlling delivery of energy from an input of a lamp assembly to a load of the lamp assembly. The control circuit may transfer a first amount of energy from an input to a load (e.g., comprising one or more light-emitting diodes) to cause the load to generate light external to the lamp assembly in accordance with a control setting of a dimmer indicating a user-desired amount of energy to be transferred to the load. The control circuit may also transfer a second amount of energy from the input to a second load to cause the second load (e.g., comprising one or more lower-efficacy light-emitting diodes) to dissipate the second amount of energy external to the lamp assembly, wherein the second amount of energy comprises energy present in the input signal other than the first amount of energy.

12 Claims, 18 Drawing Sheets

(56) References Cited

U.S. PATENT DOCUMENTS

| | | | | |
|---|---|---|---|---|
| 5,900,683 | A | 5/1999 | Rinehart et al. | |
| 5,952,849 | A | 9/1999 | Haigh | |
| 5,966,297 | A | 10/1999 | Minegishi | |
| 6,385,063 | B1 | 5/2002 | Sadek et al. | |
| 6,407,691 | B1 | 6/2002 | Yu | |
| 6,621,256 | B2 | 9/2003 | Muratov et al. | |
| 6,873,065 | B2 | 3/2005 | Haigh et al. | |
| 7,003,023 | B2 | 2/2006 | Krone et al. | |
| 7,050,509 | B2 | 5/2006 | Krone et al. | |
| 7,075,329 | B2 | 7/2006 | Chen et al. | |
| 7,078,963 | B1 | 7/2006 | Andersen et al. | |
| 7,382,635 | B2 | 6/2008 | Noda | |
| 7,538,499 | B2 | 5/2009 | Ashdown | |
| 7,561,394 | B2 | 7/2009 | Mulligan et al. | |
| 7,786,711 | B2 | 8/2010 | Wei et al. | |
| 2002/0150151 | A1 | 10/2002 | Krone et al. | |
| 2004/0105283 | A1 | 6/2004 | Schie et al. | |
| 2004/0232971 | A1 | 11/2004 | Kawasaki et al. | |
| 2006/0208669 | A1 | 9/2006 | Huynh et al. | |
| 2007/0182338 | A1 | 8/2007 | Shteynberg et al. | |
| 2008/0143266 | A1 | 6/2008 | Langer | |
| 2008/0192509 | A1 | 8/2008 | Dhuyvetter et al. | |
| 2008/0232128 | A1* | 9/2008 | Shofar | F21V 23/04 362/545 |
| 2009/0147544 | A1 | 6/2009 | Melanson | |
| 2009/0195186 | A1 | 8/2009 | Guest et al. | |
| 2010/0066328 | A1 | 3/2010 | Shimizu et al. | |
| 2011/0204797 | A1 | 8/2011 | Lin et al. | |
| 2011/0204820 | A1* | 8/2011 | Tikkanen | H05B 33/0815 315/294 |
| 2012/0068626 | A1 | 3/2012 | Lekatsas et al. | |
| 2012/0268020 | A1 | 10/2012 | Newman, Jr. et al. | |
| 2012/0280637 | A1* | 11/2012 | Tikkanen | H05B 33/0803 315/294 |
| 2013/0038242 | A1 | 2/2013 | Athalye | |
| 2013/0293151 | A1* | 11/2013 | Puvanakijjakorn | H05B 33/0815 315/297 |

FOREIGN PATENT DOCUMENTS

| | | | |
|---|---|---|---|
| EP | 1768257 | A | 3/2007 |
| JP | 2009170240 | A | 1/2008 |
| WO | 1999017591 | A1 | 4/1999 |
| WO | 2010011971 | A1 | 1/2010 |

OTHER PUBLICATIONS

Linear Technology, LTC3705, "2-Switch Forward Controller and Gate Driver", 2005, pp. 1-20, Milpitas, California, USA.

International Search Report and Written Opinion, International Patent Application No. PCT/US2015/036371, dated Aug. 19, 2015, 14 pages.

* cited by examiner

SYSTEMS AND METHODS FOR MAINTAINING DIMMER BEHAVIOR IN A LOW-POWER LAMP ASSEMBLY

FIELD OF DISCLOSURE

The present disclosure relates in general to the field of electronics, and more specifically to systems and methods for maintaining desired behavior of a dimmer associated with a lightning system.

BACKGROUND

Many electronic systems include circuits, such as switching power converters or transformers that interface with a dimmer. The interfacing circuits deliver power to a load in accordance with the dimming level set by the dimmer. For example, in a lighting system, dimmers provide an input signal to a lighting system. The input signal represents a dimming level that causes the lighting system to adjust power delivered to a lamp, and, thus, depending on the dimming level, increase or decrease the brightness of the lamp. Many different types of dimmers exist. In general, dimmers generate an output signal in which a portion of an alternating current ("AC") input signal is removed or zeroed out. For example, some analog-based dimmers utilize a triode for alternating current ("triac") device to modulate a phase angle of each cycle of an alternating current supply voltage. This modulation of the phase angle of the supply voltage is also commonly referred to as "phase cutting" the supply voltage. Phase cutting the supply voltage reduces the average power supplied to a load, such as a lighting system, and thereby controls the energy provided to the load.

A particular type of a triac-based, phase-cutting dimmer is known as a leading-edge dimmer. A leading-edge dimmer phase cuts from the beginning of an AC cycle, such that during the phase-cut angle, the dimmer is "off" and supplies no output voltage to its load, and then turns "on" after the phase-cut angle and passes phase cut input signal to its load. To ensure proper operation, the load must provide to the leading-edge dimmer a load current sufficient to maintain an inrush current above a current necessary for opening the triac. Due to the sudden increase in voltage provided by the dimmer and the presence of capacitors in the dimmer, the current that must be provided is typically substantially higher than the steady state current necessary for triac conduction. Additionally, in steady state operation, the load must provide to the dimmer a load current to remain above another threshold known as a "hold current" needed to prevent premature disconnection of the triac.

FIG. 1 depicts a lighting system 100 that includes a triac-based leading-edge dimmer 102 and a lamp 142. FIG. 2 depicts example voltage and current graphs associated with lighting system 100. Referring to FIGS. 1 and 2, lighting system 100 receives an AC supply voltage $V_{SUPPLY}$ from voltage supply 104. The supply voltage $V_{SUPPLY}$ is, for example, a nominally 60 Hz/110 V line voltage in the United States of America or a nominally 50 Hz/220 V line voltage in Europe. Triac 106 acts as a voltage-driven switch, and a gate terminal 108 of triac 106 controls current flow between the first terminal 110 and the second terminal 112. A gate voltage $V_G$ on the gate terminal 108 above a firing threshold voltage value $V_F$ will cause triac 106 to turn ON, in turn causing a short of capacitor 121 and allowing current to flow through triac 106 and dimmer 102 to generate an output current $i_{DIM}$.

Assuming a resistive load for lamp 142, the dimmer output voltage $V_{\Phi_DIM}$ is zero volts from the beginning of each of half cycles 202 and 204 at respective times $t_0$ and $t_2$ until the gate voltage $V_G$ reaches the firing threshold voltage value $V_F$. Dimmer output voltage $V_{\Phi_DIM}$ represents the output voltage of dimmer 102. During timer period $t_{OFF}$, the dimmer 102 chops or cuts the supply voltage $V_{SUPPLY}$ so that the dimmer output voltage $V_{\Phi_DIM}$ remains at zero volts during time period $t_{OFF}$. At time $t_1$, the gate voltage $V_G$ reaches the firing threshold value $V_F$, and triac 106 begins conducting. Once triac 106 turns ON, the dimmer voltage $V_{\Phi_DIM}$ tracks the supply voltage $V_{SUPPLY}$ during time period $t_{ON}$.

Once triac 106 turns ON, the current $i_{DIM}$ drawn from triac 106 must exceed an attach current $i_{ATT}$ in order to sustain the inrush current through triac 106 above a threshold current necessary for opening triac 106. In addition, once triac 106 turns ON, triac 106 continues to conduct current $i_{DIM}$ regardless of the value of the gate voltage $V_G$ as long as the current $i_{DIM}$ remains above a holding current value $i_{HC}$. The attach current value $i_{ATT}$ and the holding current value $i_{HC}$ is a function of the physical characteristics of the triac 106. Once the current $i_{DIM}$ drops below the holding current value $i_{HC}$, i.e. $i_{DIM}<i_{HC}$, triac 106 turns OFF (i.e., stops conducting), until the gate voltage $V_G$ again reaches the firing threshold value $V_F$. In many traditional applications, the holding current value $i_{HC}$ is generally low enough so that, ideally, the current $i_{DIM}$ drops below the holding current value $i_{HC}$ when the supply voltage $V_{SUPPLY}$ is approximately zero volts near the end of the half cycle 202 at time $t_2$.

The variable resistor 114 in series with the parallel connected resistor 116 and capacitor 118 form a timing circuit 115 to control the time $t_1$ at which the gate voltage $V_G$ reaches the firing threshold value $V_F$. Increasing the resistance of variable resistor 114 increases the time $t_{OFF}$, and decreasing the resistance of variable resistor 114 decreases the time $t_{OFF}$. The resistance value of the variable resistor 114 effectively sets a dimming value for lamp 142. Diac 119 provides current flow into the gate terminal 108 of triac 106. The dimmer 102 also includes an inductor choke 120 to smooth the dimmer output voltage $V_{\Phi_DIM}$. As known in the art, an inductor choke is a passive two-terminal electronic component (e.g., an inductor) which is designed specifically for blocking higher-frequency alternating current (AC) in an electrical circuit, while allowing lower frequency or direct current to pass. Triac-based dimmer 102 also includes a capacitor 121 connected across triac 106 and inductor choke 120 to reduce electro-magnetic interference.

Ideally, modulating the phase angle of the dimmer output voltage $V_{\Phi_DIM}$ effectively turns the lamp 142 OFF during time period $t_{OFF}$ and ON during time period $t_{ON}$ for each half cycle of the supply voltage $V_{SUPPLY}$. Thus, ideally, the dimmer 102 effectively controls the average energy supplied to lamp 142 in accordance with the dimmer output voltage $V_{\Phi_DIM}$.

The triac-based dimmer 102 adequately functions in many circumstances, such as when lamp 142 consumes a relatively high amount of power, such as an incandescent light bulb. However, in circumstances in which dimmer 102 is loaded with a lower-power load (e.g., a light-emitting diode or LED lamp), such load may draw a small amount of current $i_{DIM}$, and it is possible that the current $i_{DIM}$ may fail to reach the attach current $i_{ATT}$ and also possible that current $i_{DIM}$ may prematurely drop below the holding current value $i_{HC}$ before the supply voltage $V_{SUPPLY}$ reaches approximately zero volts. If the current $i_{DIM}$ fails to reach the attach current $i_{ATT}$, dimmer 102 may prematurely disconnect and may not pass the appropriate portion of input voltage $V_{SUPPLY}$ to its output. If the current $i_{DIM}$ prematurely drops below the holding current value $i_{HC}$, the dimmer 102 prematurely shuts down, and the dimmer voltage $V_{\Phi_DIM}$ will prematurely drop to zero. When the dimmer voltage $V_{\Phi_DIM}$ prematurely drops to zero, the dimmer voltage $V_{\Phi_DIM}$ does not reflect the intended dimming value as set by the resistance value of variable resistor 114. For example, when the current $i_{DIM}$ drops below the holding current value $i_{HC}$ at a time significantly earlier than $t_2$ for the dimmer voltage $V_{\Phi_DIM}$ 206, the ON time period $t_{ON}$ prematurely ends at a time earlier than $t_2$ instead of ending at time $t_2$, thereby decreasing the amount of energy delivered to the load. Thus, the energy delivered to the load will not match the dimming level corresponding to the dimmer voltage $V_{\Phi_DIM}$. In addition, when $V_{\Phi_DIM}$ prematurely drops to zero, charge may accumulate on capacitor 118 and gate 108, causing triac 106 to again refire if gate voltage $V_G$ exceeds firing threshold value $V_F$ during the same half cycle 202 or 204, and/or causing triac 106 to fire incorrectly in subsequent half cycles due to such accumulated charge. Thus, premature disconnection of triac 106 may lead to errors in the timing circuitry of dimmer 102 and instability in its operation.

Another particular type of phase-cutting dimmer is known as a trailing-edge dimmer. A trailing-edge dimmer phase cuts from the end of an AC cycle, such that during the phase-cut angle, the dimmer is "off" and supplies no output voltage to its load, but is "on" before the phase-cut angle and in an ideal case passes a waveform proportional to its input voltage to its load.

FIG. 3 depicts a lighting system 300 that includes a trailing-edge, phase-cut dimmer 302 and a lamp 342. FIG. 4 depicts example voltage and current graphs associated with lighting system 300. Referring to FIGS. 3 and 4, lighting system 300 receives an AC supply voltage $V_{SUPPLY}$ from voltage supply 304. The supply voltage $V_{SUPPLY}$, indicated by voltage waveform 402, is, for example, a nominally 60 Hz/110 V line voltage in the United States of America or a nominally 50 Hz/220 V line voltage in Europe. Trailing edge dimmer 302 phase cuts trailing edges, such as trailing edges 402 and 404, of each half cycle of supply voltage $V_{SUPPLY}$. Since each half cycle of supply voltage $V_{SUPPLY}$ is 180 degrees of the supply voltage $V_{SUPPLY}$, the trailing edge dimmer 302 phase cuts the supply voltage $V_{SUPPLY}$ at an angle greater than 0 degrees and less than 180 degrees. The phase cut, input voltage $V_{\Phi_DIM}$ to lamp 342 represents a dimming level that causes the lighting system 300 to adjust power delivered to lamp 342, and, thus, depending on the dimming level, increase or decrease the brightness of lamp 342.

Dimmer 302 includes a timer controller 310 that generates dimmer control signal DCS to control a duty cycle of switch 312. The duty cycle of switch 312 is a pulse width (e.g., times $t_1$-$t_0$) divided by a period of the dimmer control signal (e.g., times $t_3$-$t_0$) for each cycle of the dimmer control signal DCS. Timer controller 310 converts a desired dimming level into the duty cycle for switch 312. The duty cycle of the dimmer control signal DCS is decreased for lower dimming levels (i.e., higher brightness for lamp 342) and increased for higher dimming levels. During a pulse (e.g., pulse 406 and pulse 408) of the dimmer control signal DCS, switch 312 conducts (i.e., is "on"), and dimmer 302 enters a low resistance state. In the low resistance state of dimmer 302, the resistance of switch 312 is, for example, less than or equal to 10 ohms. During the low resistance state of switch 312, the phase cut, input voltage $V_{\Phi_DIM}$ tracks the input supply voltage $V_{SUPPLY}$ and dimmer 302 transfers a dimmer current $i_{DIM}$ to lamp 342.

When timer controller 310 causes the pulse of dimmer control signal 406 to end, dimmer control signal 406 turns switch 312 off, which causes dimmer 302 to enter a high resistance state (i.e., turns off). In the high resistance state of dimmer 302, the resistance of switch 312 is, for example, greater than 1 kiloohm. Dimmer 302 includes a capacitor 314, which charges to the supply voltage $V_{SUPPLY}$ during each pulse of the timer control signal DCS. In both the high and low resistance states of dimmer 302, the capacitor 314 remains connected across switch 312. When switch 312 is off and dimmer 302 enters the high resistance state, the voltage $V_V$ across capacitor 314 increases (e.g., between times $t_1$ and $t_2$ and between times $t_4$ and $t_5$). The rate of increase is a function of the amount of capacitance C of capacitor 314 and the input impedance of lamp 342. If effective input resistance of lamp 342 is low enough, it permits a high enough value of the dimmer current $i_{DIM}$ to allow the phase cut, input voltage $V_{\Phi_DIM}$ to decay to a zero crossing (e.g., at times $t_2$ and $t_5$) before the next pulse of the dimmer control signal DCS.

Dimming a light source with dimmers saves energy when operating a light source and also allows a user to adjust the intensity of the light source to a desired level. However, conventional dimmers, such as triac-based leading-edge dimmers and trailing-edge dimmers, that are designed for use with resistive loads, such as incandescent light bulbs, often do not perform well when supplying a raw, phase modulated signal to a reactive load such as an electronic power converter, as may be used in connection with a low-power lamp. Thus, lightning systems including such reactive loads must typically include circuitry for handling reactive energy of the dimmer and other components of the lighting system in order to achieve compatibility between the dimmer and the load so that the dimmer operates in a stable manner. FIGS. 5 and 6 depict lighting systems employing known approaches to handle such reactive energy.

In lighting system 500 of FIG. 5, dimmer voltage $V_{\Phi_DIM}$ is converted by a power converter 522 to an output voltage $V_{OUT}$ in order to provide a desired energy output to lamp 542 in accordance with the dimmer control setting (e.g., phase angle) of dimmer 502. Additional reactive energy, attach energy associated with providing an attached current, or other energy present in lighting system 500 may be dissipated in a dissipative circuit 552 integral to the lamp assembly housing lamp 542, thus generating heat. In some lighting systems (e.g., those coupled to 230V supplies), the amount of energy to be dissipated to dissipative circuit 552 may be significant, placing challenges on thermal design of power converter 522.

In lighting system 600 of FIG. 6, dimmer voltage $V_{\Phi_DIM}$ is converted by a power converter 622 to an output voltage $V_{OUT}$ in order to provide a desired energy output to lamp 642 in accordance with the dimmer control setting (e.g., phase angle) of dimmer 602. Furthermore, additional reactive energy, attach energy associated with providing an attached current, or other energy present in lighting system 600 may also be distributed to lamp 642 in order to dissipate the reactive energy, attach energy, or other energy. While the approach depicted in FIG. 6 is a design choice that may have advantages to that over the approach in FIG. 5, in that the approach of FIG. 6 passes energy to be dissipated to lamp 642 in order to avoid dissipation of energy internally to the lamp assembly. However, such approach may limit the dimming range of lighting system 600. For example, the approach depicted in FIG. 6 may permit lamp 642 to be dimmed to a minimum of 25% of its maximum output level, and thus may be undesirable.

SUMMARY

In accordance with the teachings of the present disclosure, certain disadvantages and problems associated with maintaining desired behavior of a dimmer in a lightning system may be reduced or eliminated.

In accordance with embodiments of the present disclosure, an apparatus may include a control circuit for controlling delivery of energy from an input of a lamp assembly to a load of the lamp assembly. The control circuit may be configured to determine from an input signal on the input of the lamp assembly a control setting of a dimmer electrically coupled to the input, transfer a first amount of energy from the input to the load to cause the load to generate light external to the lamp assembly in accordance with the control setting, wherein the control setting indicates a user-desired amount of energy to be transferred to the load, and transfer a second amount of energy from the input to a second load to cause the second load to dissipate the second amount of energy external to the lamp assembly, wherein the second amount of energy comprises energy present in the input signal other than the first amount of energy.

In accordance with these and other embodiments of the present disclosure, an apparatus may include a control circuit for controlling delivery of energy from an input of a lamp assembly to a load of the lamp assembly. The control circuit may be configured to determine from an input signal on the input of the lamp assembly a control setting of a dimmer electrically coupled to the input, transfer a first amount of energy from the input to the load to cause the load to generate light external to the lamp assembly in accordance with the control setting, wherein the control setting indicates a user-desired amount of energy to be transferred to the load, and transfer a second amount of energy from the input to a voltage regulator within the lamp assembly, wherein the voltage regulator is configured to supply electrical energy to a device present in the lamp assembly and the second amount of energy comprises energy present in the input signal other than the first amount of energy.

In accordance with these and other embodiments of the present disclosure, a method for controlling delivery of energy from an input of a lamp assembly to a load of the lamp assembly may comprise determining from an input signal on the input of the lamp assembly a control setting of a dimmer electrically coupled to the input, transferring a first amount of energy from the input to the load to cause the load to generate light external to the lamp assembly in accordance with the control setting, wherein the control setting indicates a user-desired amount of energy to be transferred to the load, and transferring a second amount of energy from the input to a second load to cause the second load to dissipate the second amount of energy external to the lamp assembly, wherein the second amount of energy comprises energy present in the input signal other than the first amount of energy.

In accordance with these and other embodiments of the present disclosure, a method for controlling delivery of energy from an input of a lamp assembly to a load of the lamp assembly may comprise determining from an input signal on the input of the lamp assembly a control setting of a dimmer electrically coupled to the input, transferring a first amount of energy from the input to the load to cause the load to generate light external to the lamp assembly in accordance with the control setting, wherein the control setting indicates a user-desired amount of energy to be transferred to the load, and transferring a second amount of energy from the input to a voltage regulator within the lamp assembly, wherein the voltage regulator is configured to supply electrical energy to a device present in the lamp assembly and the second amount of energy comprises energy present in the input signal other than the first amount of energy.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 7:
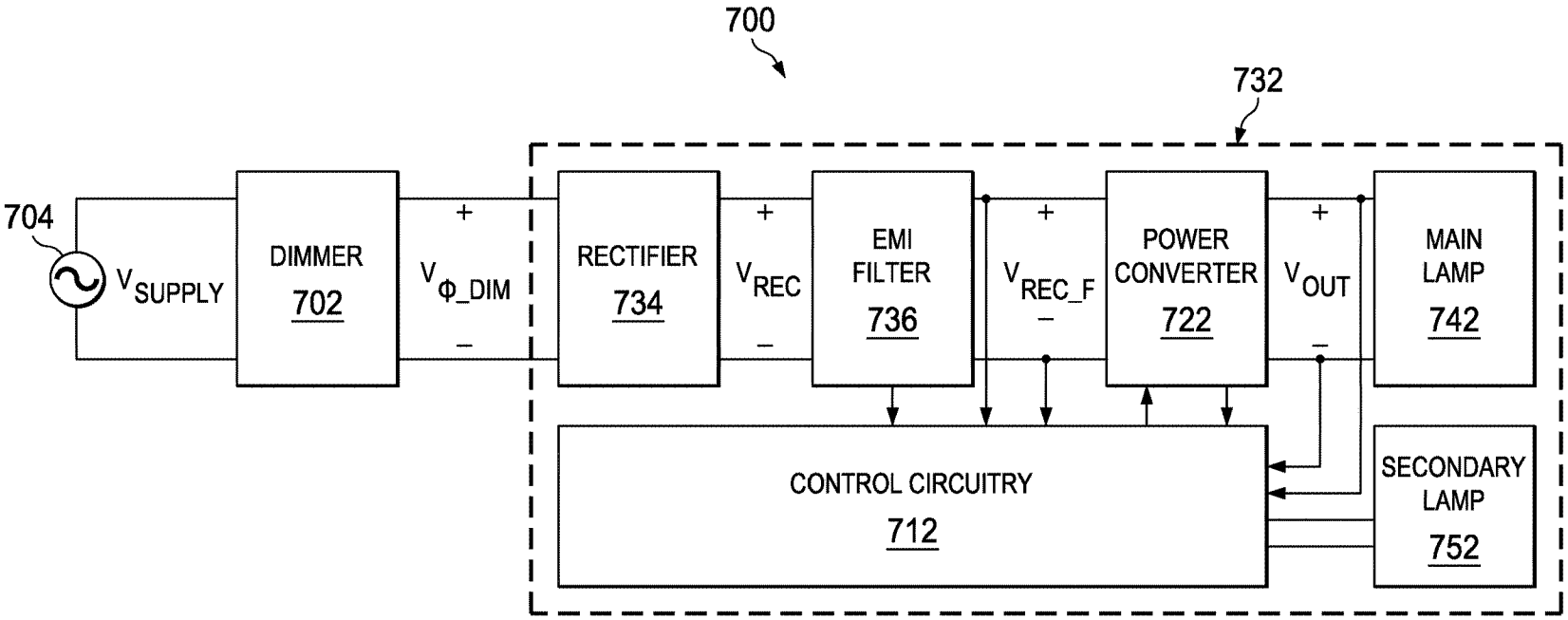
FIG. 7 illustrates an example lighting system including control circuitry for providing compatibility between a low-power lamp and other elements of a lighting system, in accordance with embodiments of the present disclosure.

FIG. 7 illustrates an example lighting system 700 including control circuitry 712 for providing compatibility between a low-power lamp 742 and other elements of lighting system 700, in accordance with embodiments of the present disclosure. As shown in FIG. 7, lightning system 700 may include a voltage supply 704, a dimmer 702, and a lamp assembly 732. Voltage supply 704 may generate a supply voltage $V_{SUPPLY}$ that is, for example, a nominally 60 Hz/110 V line voltage in the United States of America or a nominally 50 Hz/220 V line voltage in Europe.

Figure 1:
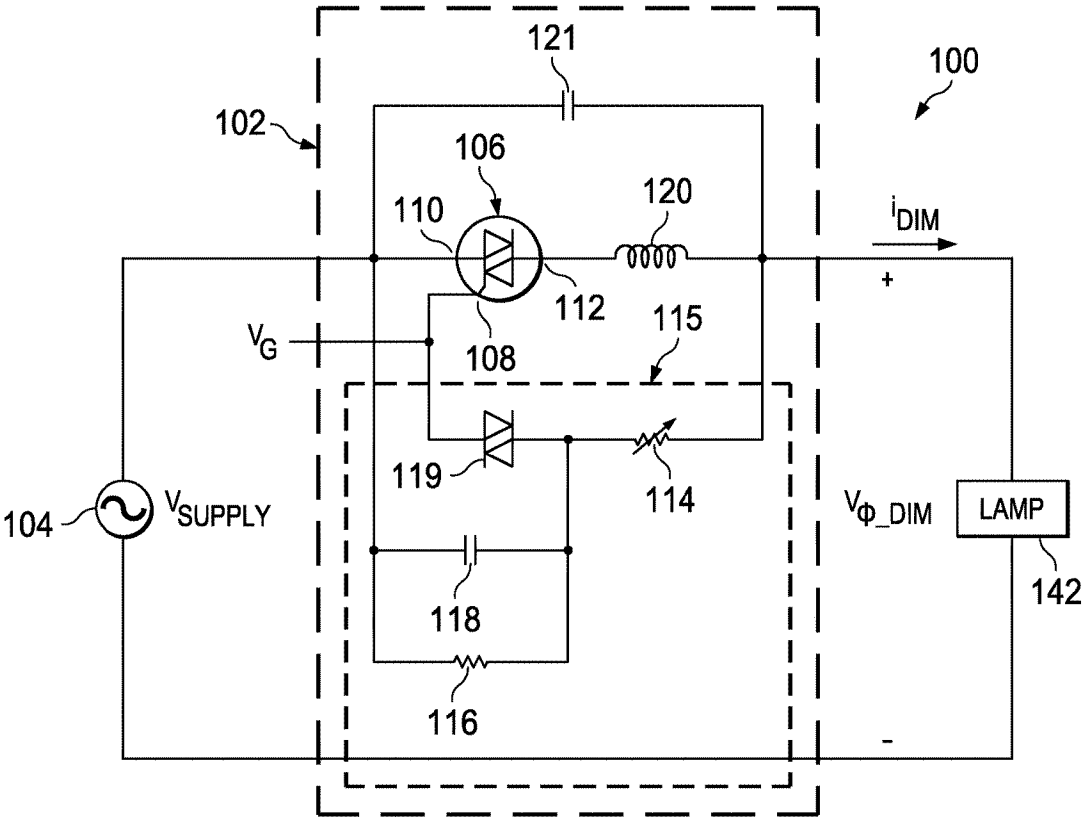
FIG. 1 (PRIOR ART)
FIG. 1 illustrates a lighting system that includes a triac-based leading-edge dimmer, as is known in the art.
Figure 3:
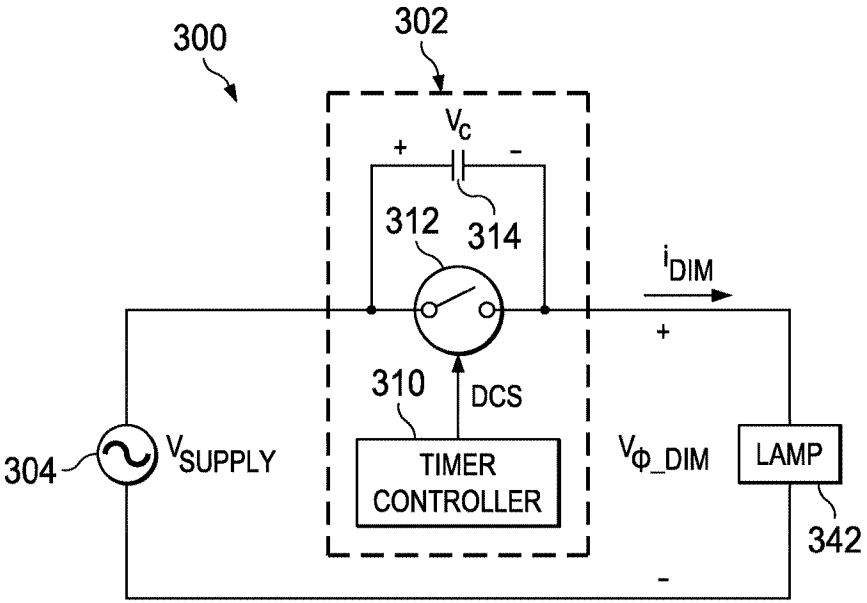
FIG. 3 (PRIOR ART)
FIG. 3 illustrates a lighting system that includes a phase-cut trailing-edge dimmer, as is known in the art.
Figure 2:
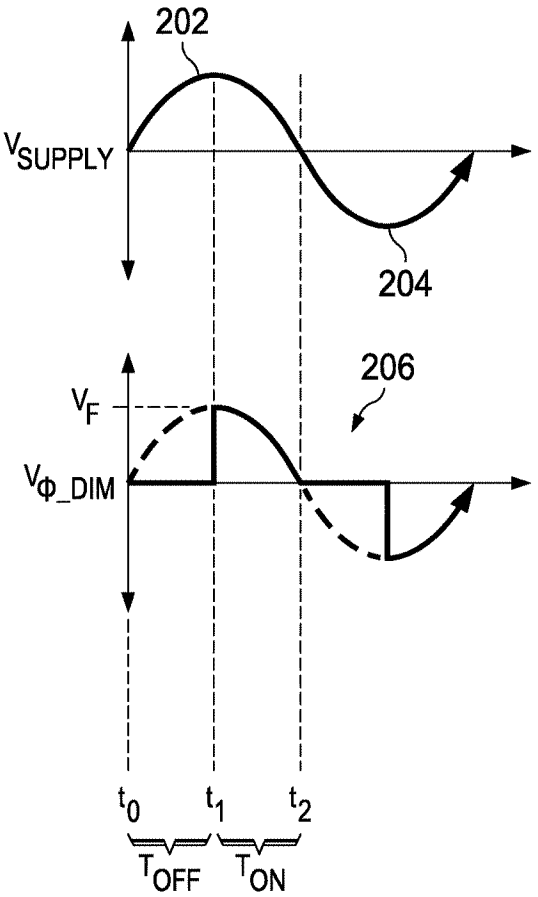
FIG. 2 (PRIOR ART)
FIG. 2 illustrates example voltage and current graphs associated with the lighting system depicted in FIG. 1, as is known in the art.
Figure 4:
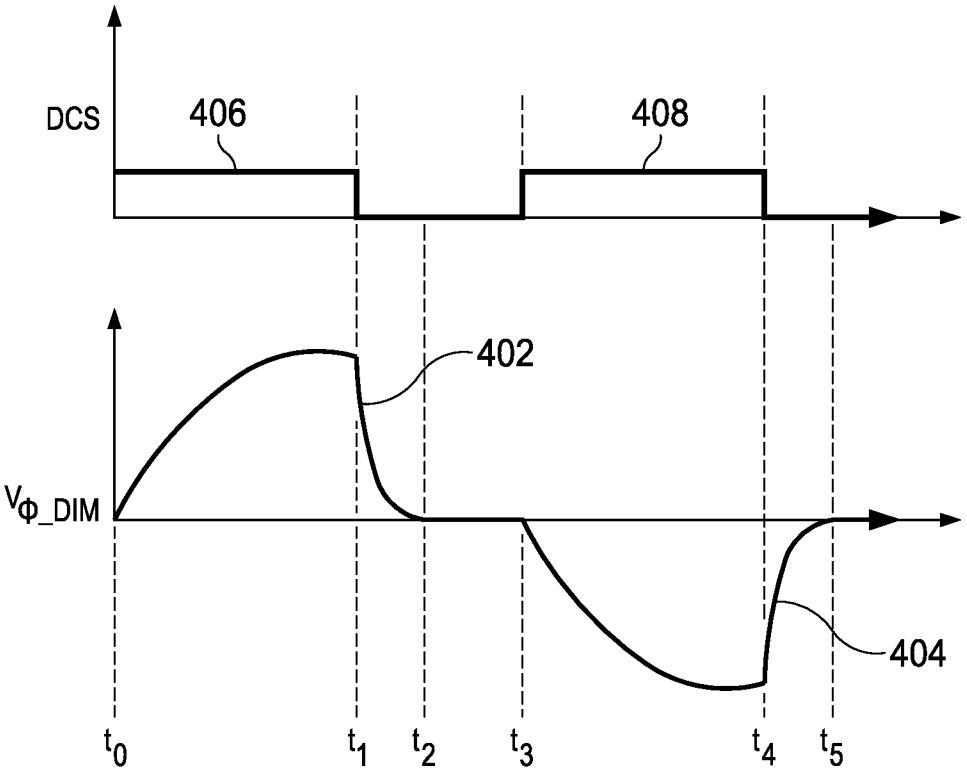
FIG. 4 (PRIOR ART)
FIG. 4 illustrates example voltage and current graphs associated with the lighting system depicted in FIG. 3, as is known in the art.
Figure 5:
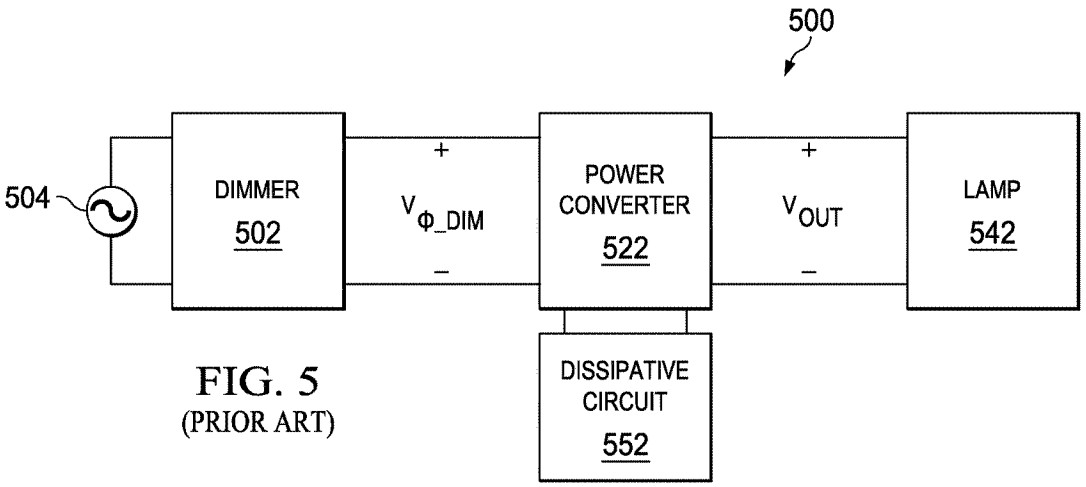
FIG. 5 (PRIOR ART)
FIG. 5 illustrates a lighting system including circuitry to dissipating reactive energy of the lighting system, as is known in the art.

Dimmer 702 may comprise any system, device, or apparatus for generating a dimming signal $V_{\Phi_DIM}$ to other elements of lighting system 700, the dimming signal representing a dimming level that causes lighting system 700 to adjust power delivered to a lamp, and, thus, depending on the dimming level, increase or decrease the brightness of lamp 742. Thus, dimmer 702 may include a leading-edge dimmer similar or identical to that depicted in FIG. 1, a trailing-edge dimmer similar to that depicted in FIG. 3, or any other suitable dimmer.

Lamp assembly 732 may include any system, device, or apparatus for converting all or a portion of electrical energy received at its input to photonic energy by lamp 742. In addition, lamp assembly 732 may include circuitry for providing compatibility between dimmer 702 and lamp 742. In some embodiments, lamp assembly 732 may comprise a multifaceted reflector form factor (e.g., an MR16 form factor). As shown in FIG. 7, lamp assembly 732 may include a rectifier 734, an electromagnetic interference (EMI) filter 736, a power converter 722, a main lamp 742, a secondary lamp 752, and control circuitry 712.

Rectifier 734 may comprise any suitable electrical or electronic device as is known in the art for converting the whole of alternating current voltage dimming signal $V_{\Phi_DIM}$ into a rectified voltage signal $V_{REC}$ having only one polarity.

EMI filter 736 may comprise any suitable electrical or electronic device as is known in the art for filtering or rejecting electromagnetic interference that may impinge upon lamp assembly 732 and be present in rectified voltage signal $V_{REC}$, thus generating a filtered rectified voltage $V_{REC_F}$.

Power converter 722 may comprise any system, device, or apparatus configured to convert an input voltage (e.g., $v_{REC_F}$) to a different output voltage (e.g., $v_{OUT}$) wherein the conversion is based on a control signal (e.g., a pulse-width modulated control signal communicated from control circuitry 712). Accordingly, power converter 722 may comprise a boost converter, a buck converter, a boost-buck converter, another suitable power converter, or any combination thereof.

Main lamp 742 may comprise any system, device, or apparatus for converting electrical energy (e.g., power converter 722) into photonic energy. In some embodiments, main lamp 742 may comprise an LED lamp.

Similarly, secondary lamp 752 may comprise any system, device, or apparatus for converting electrical energy (e.g., delivered by dimmer 702) into photonic energy. In some embodiments, secondary lamp 752 may comprise an LED lamp. In some embodiments, secondary lamp 752 may be of significantly less power efficacy (e.g., having at least two times less power efficacy) than main lamp 742. In these and other embodiments, main lamp 742 may be adapted to generate predominantly white light, while secondary lamp 752 may be adapted to generate amber light in the wavelength range of approximately 670 nanometers to approximately 710 nanometers.

Control circuitry 712 may comprise any system, device, or apparatus configured to, as described in greater detail elsewhere in this disclosure determine from an input signal (e.g., dimming signal $v_{\Phi_DIM}$, or a derivative thereof such as rectified voltage signal $V_{REC}$ or filtered rectified voltage signal $V_{REC_F}$) on the input of the lamp assembly a control setting (e.g., phase angle) of dimmer 702. Such control setting may indicate a user-desired amount of energy to be transferred to main lamp 742. Control circuitry 712 may also be configured to transfer a first amount of energy from the input to main lamp 742 to cause main lamp 742 to generate light external to lamp assembly 732 in accordance with the control setting. Control circuitry 712 may further be configured to transfer a second amount of energy from the input to secondary lamp 752 to cause the second load to dissipate the second amount of energy external to lamp assembly 732, wherein the second amount of energy comprises energy present in the input signal other than the first amount of energy. The second amount of energy transferred to secondary lamp 752 may comprise reactive energy associated with dimmer 702 (e.g., reactive energy incident to ensuring compatibility between dimmer 702 and lamp 742), reactive energy associated with EMI filter 736, and/or other reactive energy present in lighting system 700.

By steering reactive energy to secondary lamp 752, lighting system 700 may have numerous advantages as compared to traditional dimmer compatibility approaches. For example, because energy is output by secondary lamp 752 externally to lamp assembly 732, instead of being dissipated internally as is the case with many prior art approaches, challenges in providing for thermal management and cooling of lamp assembly 732 may be reduced or eliminated.

As another example, lamp assembly 732 may be configured such that secondary lamp 752 does not generate light unless lamp assembly 732 is coupled to a dimmer. Thus specifications for a lamp assembly may not require alteration simply by addition of secondary lamp 752.

Figure 6:
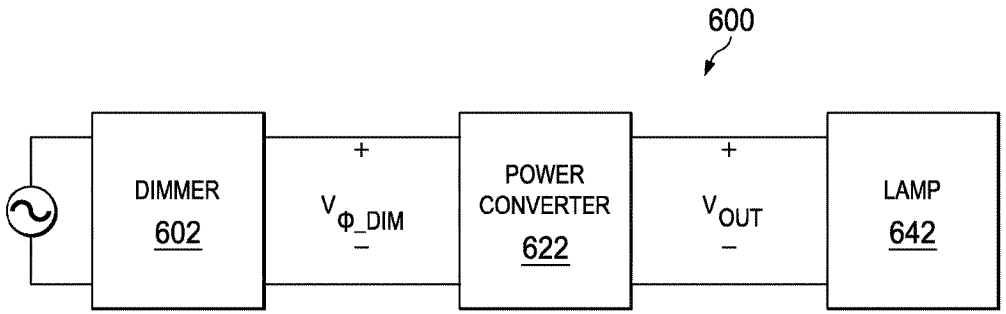
FIG. 6 (PRIOR ART)
FIG. 6 illustrates another lighting system including circuitry to dissipating reactive energy of the lighting system, as is known in the art.

As a further example, the methods and systems herein described may increase the effective dimming range relative to traditional approaches. In embodiments in which the efficacy of secondary lamp 752 is chosen to be significantly lower than that of main lamp 742, the effective light output of secondary lamp 752 may increase the effective dimming range as compared to approaches in which reactive energy is directed to the main load such as shown in FIG. 6.

As yet another example, the methods and systems herein described may not attempt to mix color to attain any specific targets of light intensity versus control setting.

Instead, as the phase angle is decreased, the power to main lamp 742 reduces proportionally, but reactive energy in lighting system 700 may not reduce. However, because the reactive energy is directed to secondary lamp 752 having, in some embodiments, a lower color temperature than main lamp 742, light output by lamp assembly 732 may attain an aesthetically-pleasing warmer color at lower dimmer phase angles.

As an additional example, the methods and systems herein described may be of relatively lower cost and/or take up less physical volume as compared to traditional approaches. In traditional approaches, dissipative elements used to dissipate reactive energy are typically bulky, and require a significant amount of space.

Control circuitry 712 may be implemented in any suitable manner in order to carry out the functionality of control circuitry described in this disclosure. Example implementations of control circuitry are set forth in FIGS. 8-16 and described below.

Figure 8A:
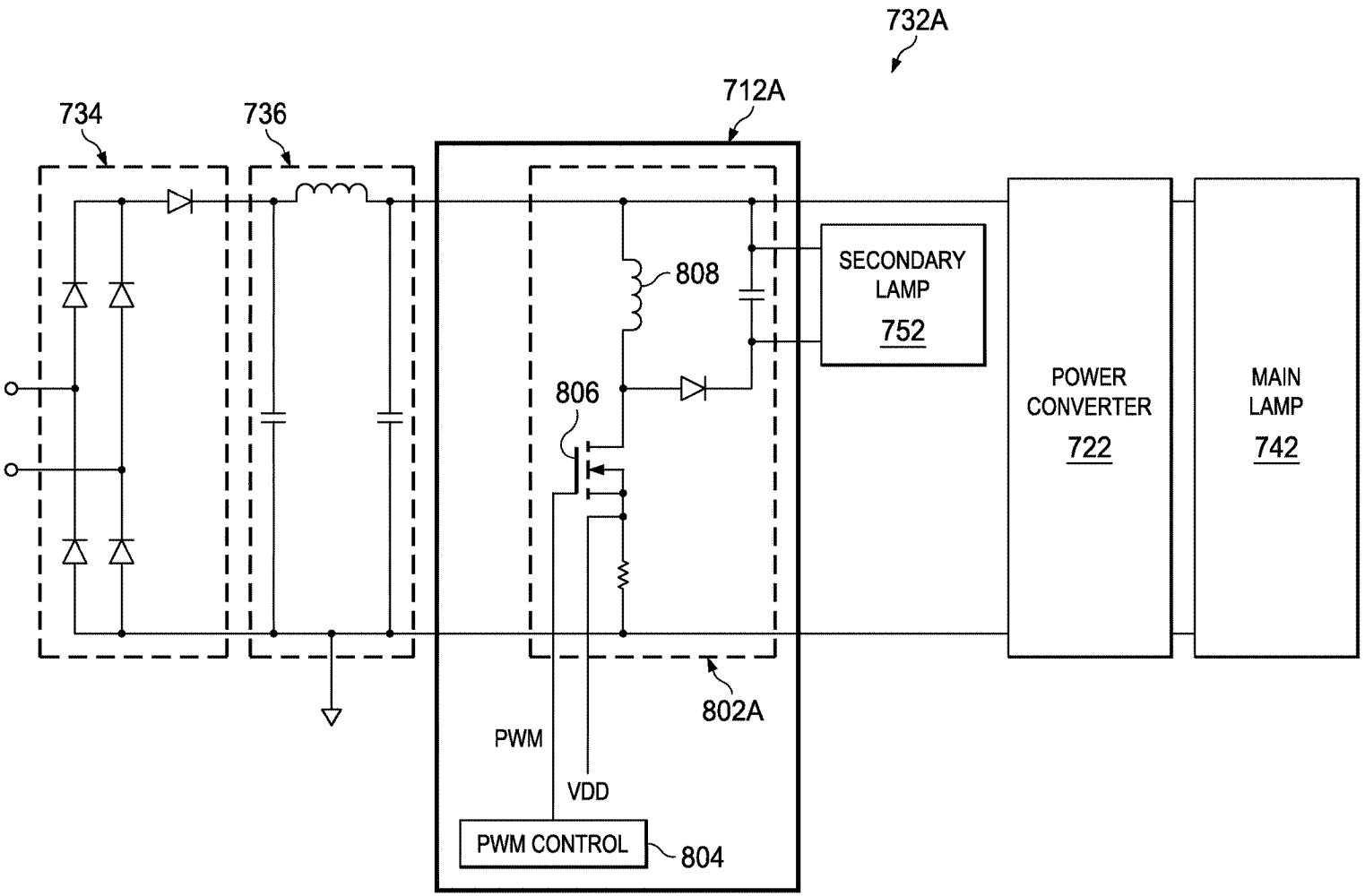
FIG. 8A illustrates an example lamp assembly having control circuitry with a buck-boost converter for controlling a secondary lamp, in accordance with embodiments of the present disclosure.
Figure 8B:
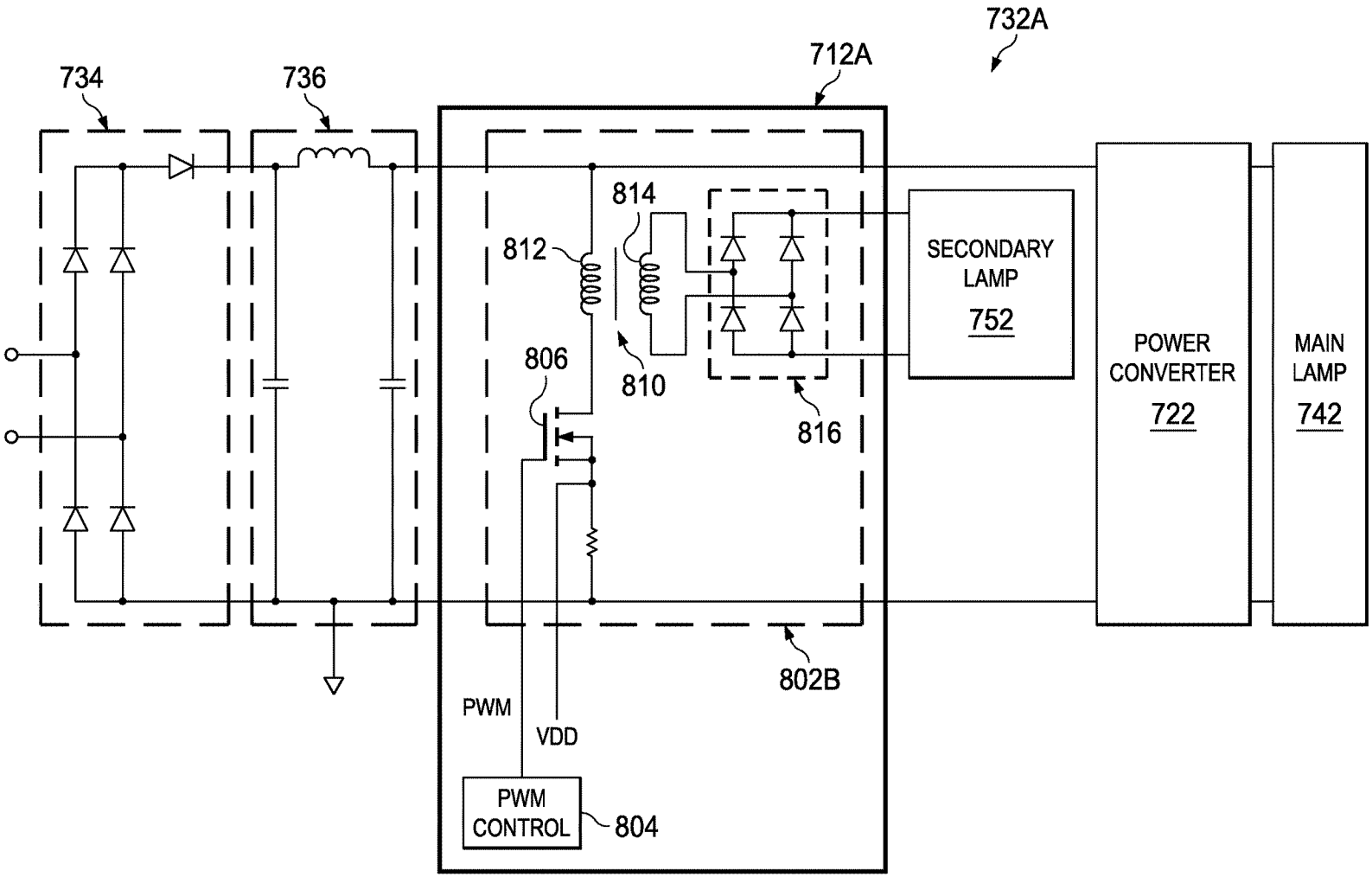
FIG. 8B illustrates an example lamp assembly having control circuitry with a buck-boost converter for controlling a secondary lamp as in FIG. 8A with an alternative embodiment of a buck-boost converter to that of FIG. 8A, in accordance with embodiments of the present disclosure.

FIG. 8A illustrates an example lamp assembly 732A having control circuitry 712A with a buck-boost converter 802A for controlling secondary lamp 752, in accordance with embodiments of the present disclosure. In this implementation, a pulse-width-modulation (PWM) control 804 may activate and deactivate switch 806 so as to charge inductor 808 when switch 806 is active and discharge inductor 808 to secondary lamp 752 when switch 806 is inactive. Control circuitry 712A may engage buck-boost converter 802A when it determines reactive energy of lighting system 700 is present to be directed to secondary lamp 752. FIG. 8B illustrates an alternative implementation of the implementation in FIG. 8A, in which buck-boost converter 802B has a different topology. In this implementation, a pulse-width-modulation (PWM) control 804 may activate and deactivate switch 806. When switch 806 is activated, current flows through winding 812 of two winding inductor 810, thus storing charge in winding 814. When switch 806 is deactivated, winding 814 may be discharged to secondary lamp 752 via bridge rectifier 816.

Figure 9:
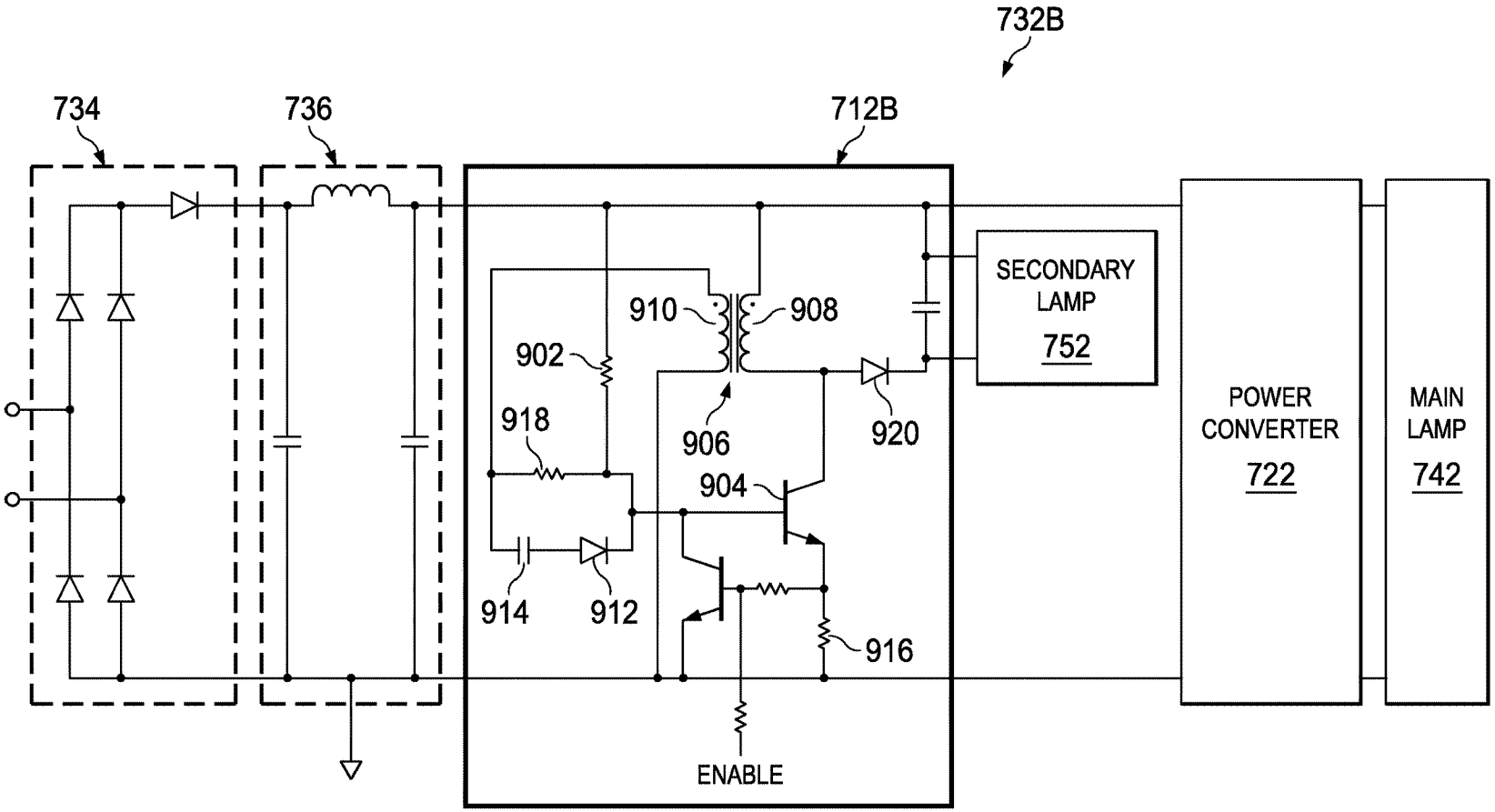
FIG. 9 illustrates an example lamp assembly having control circuitry with an autonomous blocking oscillator for controlling a secondary lamp, in accordance with embodiments of the present disclosure.

FIG. 9 illustrates an example lamp assembly 732B having control circuitry 712B implementing an autonomous blocking oscillator for controlling secondary lamp 752, in accordance with embodiments of the present disclosure. In operation, when the blocking oscillator is enabled via the signal ENABLE, current may flow through resistor 902 to bias transistor 904 on. This may in turn cause current to flow through winding 908 of inductor 906, and may also cause current through winding 910 of two-winding inductor 906, which may forward bias diode 912 allowing capacitor 914 to dump charge to the base of transistor 904. The current through winding 908 of inductor 906 may be dominated by its inductance and may rise until a voltage on resistor 916 limits the drive capability of winding 910 of inductor 906. At this point, transistor 904 may limit current flowing through winding 908 of inductor 906, and winding 908 of inductor 906 may respond to the change in current with a voltage. Winding 910 of inductor 906 may follow suit, and provide a current path from the base of transistor 904 though resistor 918. The reversal of voltage across winding 908 of inductor 906 due to the abrupt reduction in current may forward bias diode 920, passing current into secondary lamp 752. When the energy stored in inductor 906 is exhausted into current into secondary lamp 752, windings of inductor 906 may begin to oscillate, causing transistor 904 to again conduct. At this point, the current through winding 908 of inductor 906 may increase, starting a new switching cycle for the autonomous blocking oscillator.

Figure 10A:
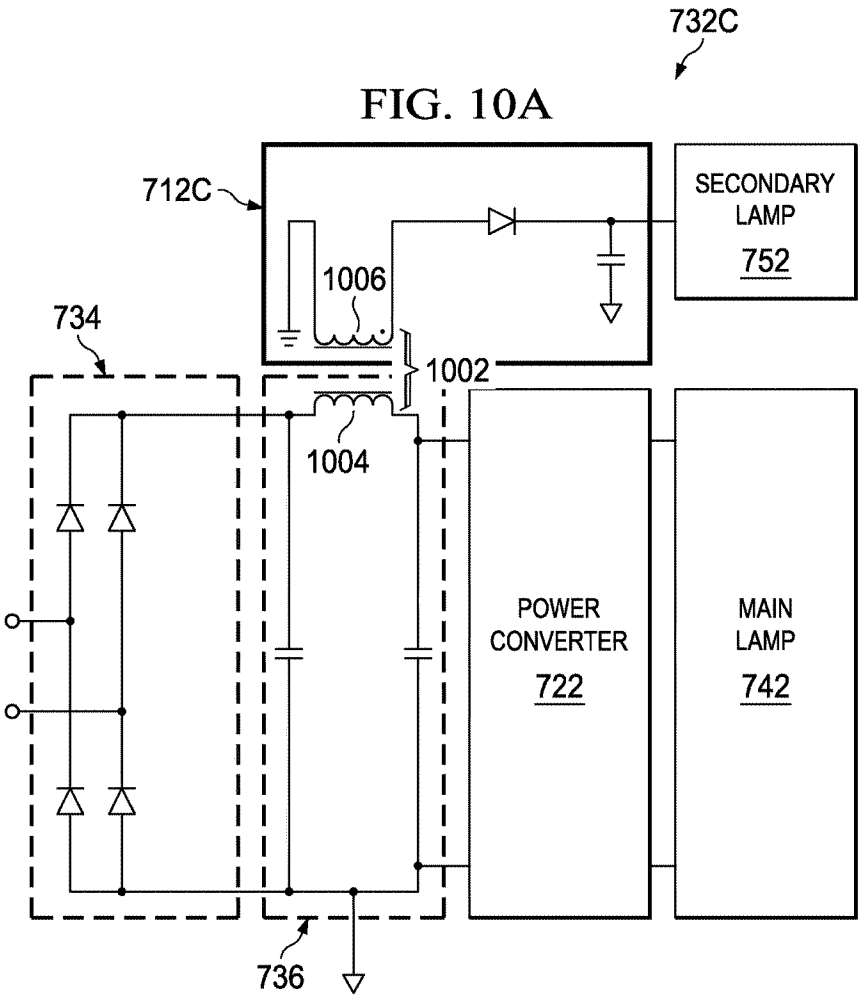
FIG. 10A illustrates an example lamp assembly having control circuitry which steers energy from an electromagnetic interference filter to a secondary lamp, in accordance with embodiments of the present disclosure.
Figure 10B:
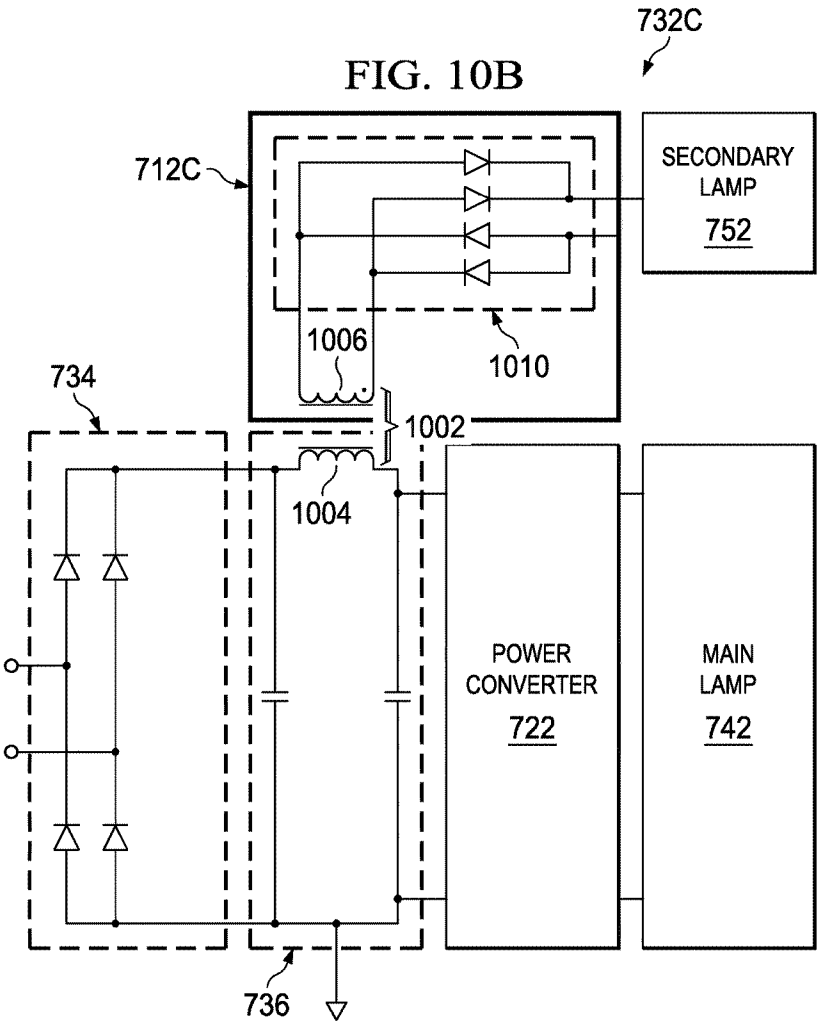
FIG. 10B illustrates another example lamp assembly having control circuitry which steers energy from an electromagnetic interference filter to a secondary lamp, in accordance with embodiments of the present disclosure.

FIG. 10A illustrates an example lamp assembly 732C having control circuitry 712C which steers energy from EMI filter 736 to secondary lamp 752, in accordance with embodiments of the present disclosure. In this embodiment, inductor 1002 may comprise a two-winding inductor having windings 1004 and 1006. In a trailing-edge dimmer, the dimmer firing and trailing-edge discharge may cause a large rate of change in current through winding 1004 of inductor 1002. This large charge in turn may induce a voltage on winding 1006 of inductor 1002, thus directing energy to secondary lamp 752. FIG. 10B illustrates an alternative implementation of control circuitry 712C in which a bridge rectifier 1010 is coupled between winding 1006 and secondary lamp 752, rather than a single-diode rectifier, as shown in FIG. 10A. In some alternate embodiments, control circuitry 712C may, instead of being implemented as shown in FIGS. 10A and 10B, include circuitry similar to that of control circuitry 712B which implements a blocking oscillator.

Figure 11:
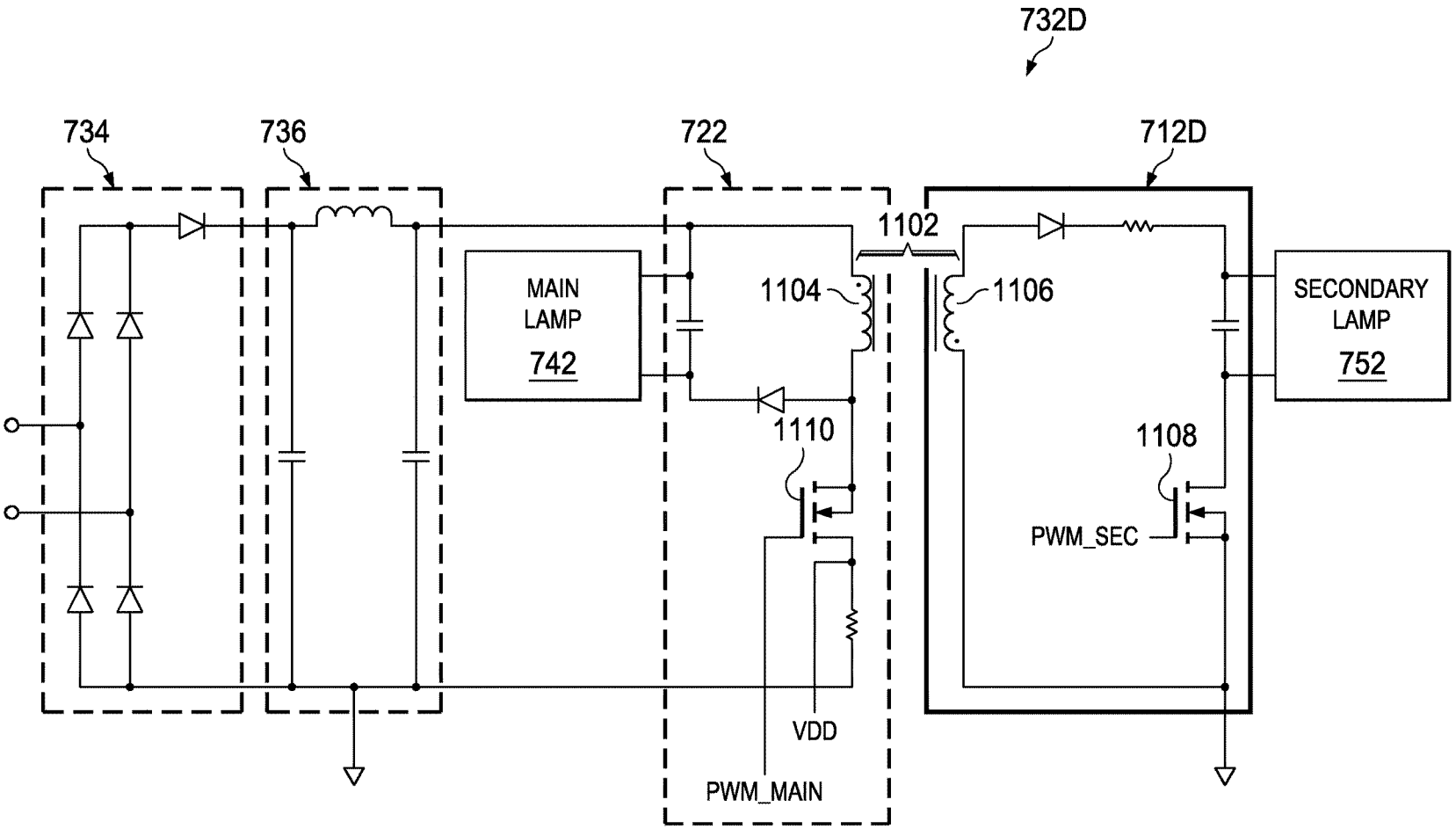
FIG. 11 illustrates an example lamp assembly having control circuitry which steers energy from an inductor of a power converter to a secondary lamp, in accordance with embodiments of the present disclosure.

FIG. 11 illustrates an example lamp assembly 732D having control circuitry 712D which steers energy from a two-winding inductor 1102 of power converter 722 to secondary lamp 752, in accordance with embodiments of the present disclosure. In this implementation, when control circuitry 712D determines that energy is to be transferred to secondary lamp 752, control circuitry may enable switch 1108. When switch 1110 is enabled, winding 1104 of inductor 1102 may be charged. When switch 1110 is disabled, energy in inductor 1102 may be split between windings 1104 and 1106 based on a ratio of reflected voltage between the windings.

Figure 12:
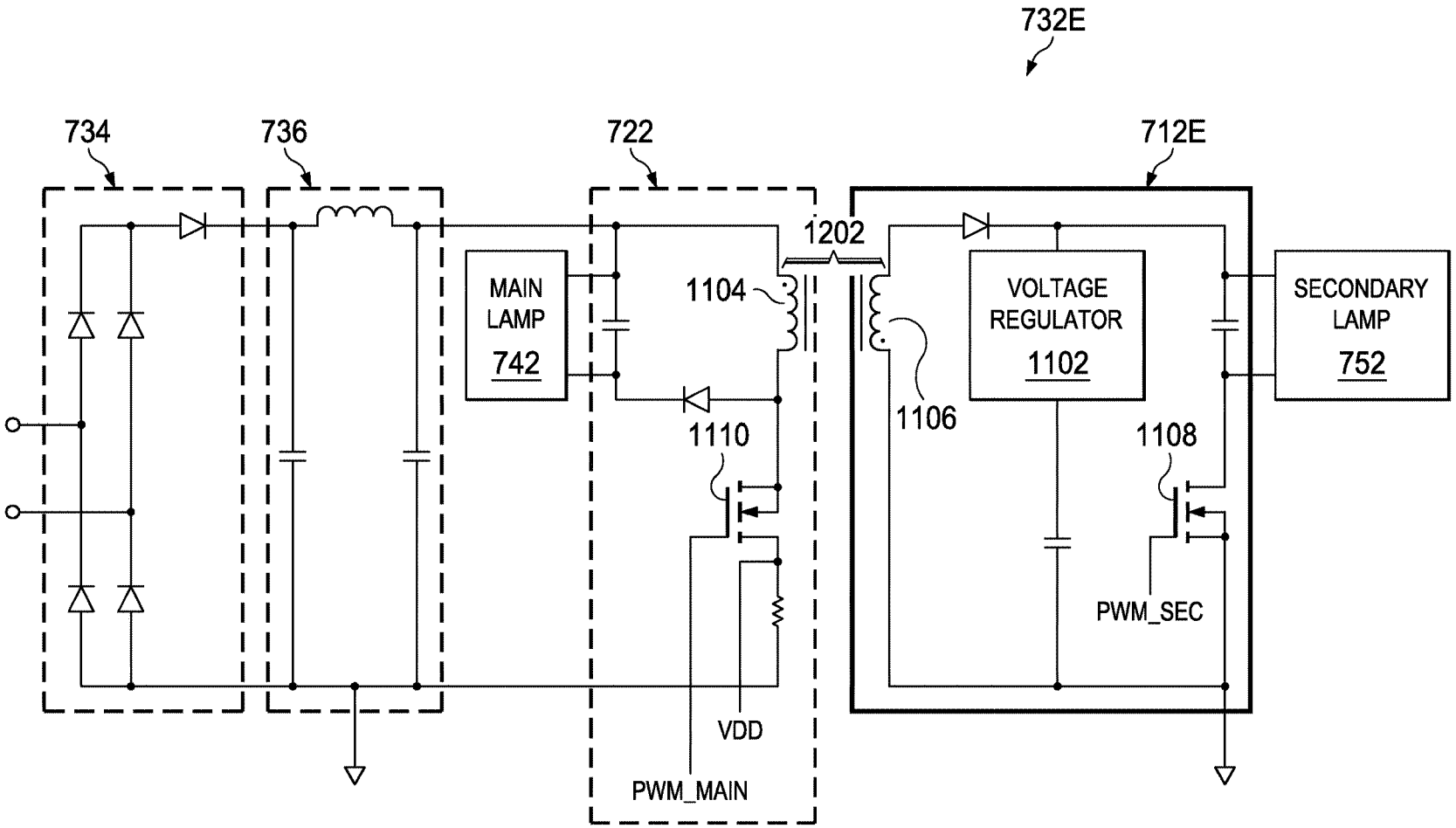
FIG. 12 illustrates an example lamp assembly having control circuitry similar to that of control circuitry of FIG. 11, but including delivery of energy to a voltage regulator, in accordance with embodiments of the present disclosure.

FIG. 12 illustrates an example lamp assembly 732E having control circuitry 712E similar to that of control circuitry 712D of FIG. 11, wherein the energy from winding 1106 of inductor 1102 is also delivered to a voltage regulator 1202. Such voltage regulator 1202 may be used to generate a bias voltage within lamp assembly 732E.

Figure 13:
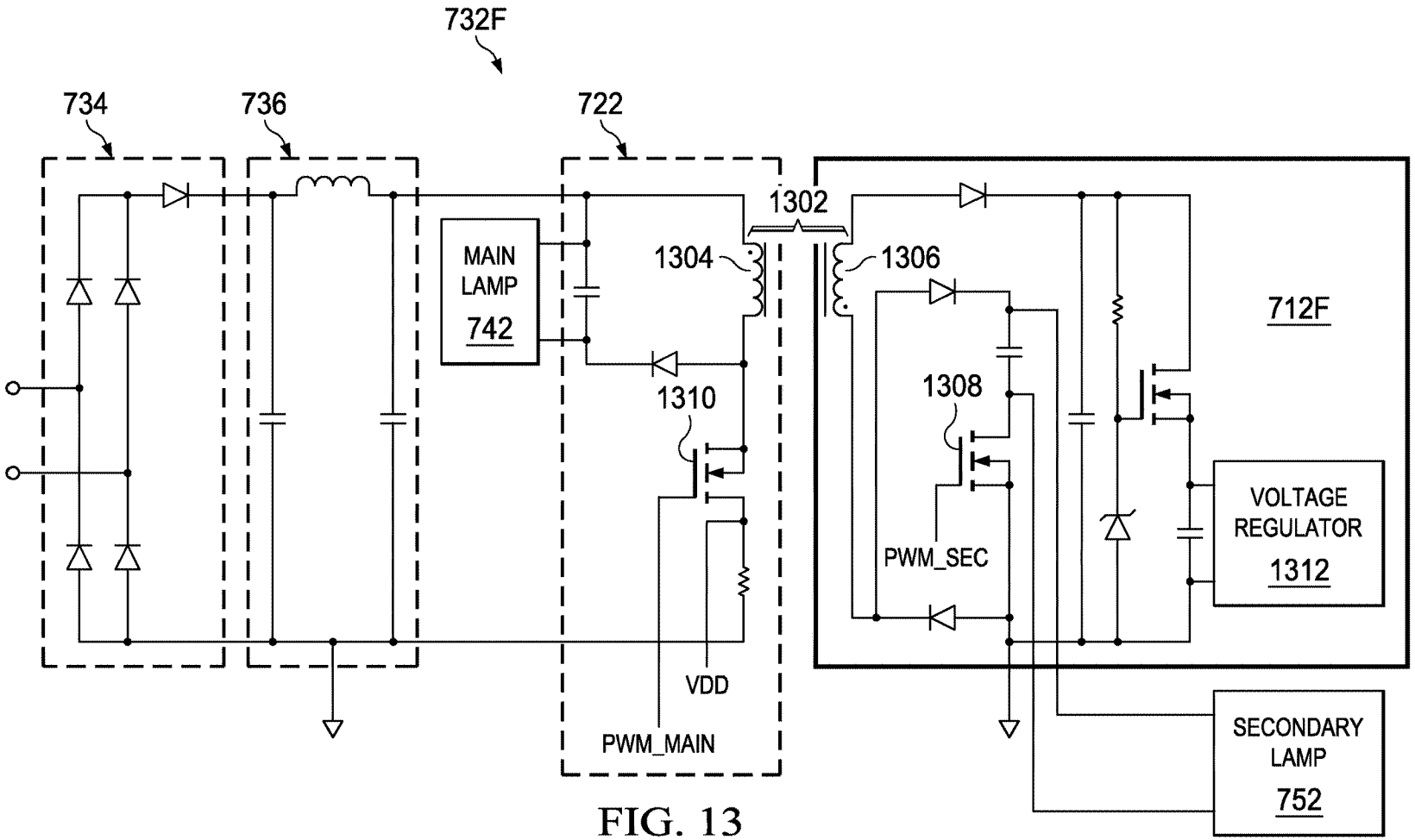
FIG. 13 illustrates an example lamp assembly having control circuitry which steers energy from an inductor of a power converter to a secondary lamp using the flyback stroke of the inductor, in accordance with embodiments of the present disclosure.

FIG. 13 illustrates an example lamp assembly 732F having control circuitry 712F which steers energy from inductor 1302 of power converter 722 to secondary lamp 752 using the flyback stroke of inductor 1302, in accordance with embodiments of the present disclosure. In this implementation, a forward stroke of inductor 1302 may be used to generate a bias voltage in winding 1306 of inductor 1302 and the flyback stroke may deliver power to secondary lamp 752 from winding 1306 if switch 1308 is enabled. When switch 1310 is enabled, windings 1304 and 1306 of inductor 1302 may be charged. When switch 1310 is disabled, winding 1304 may discharge to main lamp 742 and winding 1306 may discharge to secondary lamp 752 when switch 1308 is enabled while switch 1310 is disabled. In addition, when switch 1310 is disabled, winding 1306 may discharge to voltage regulator 1312, in order to regenerate a voltage within lamp assembly 732F. Such voltage regeneration using an auxiliary winding similar to winding 1306 is often common in existing lamp assemblies, and thus leveraging such auxiliary winding 1306 to provide energy to secondary lamp 752 may reduce cost and complexity of a design.

Figure 14:
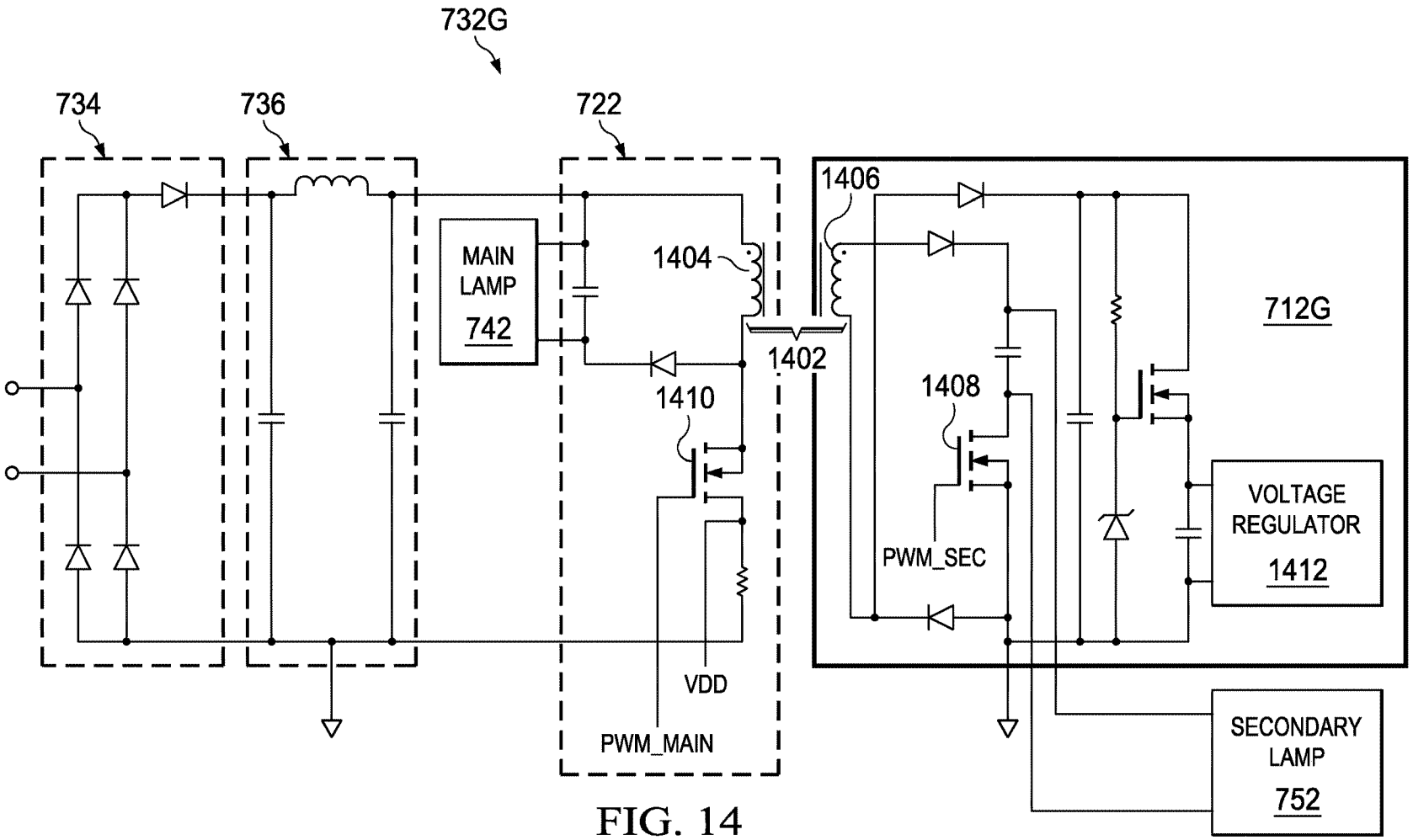
FIG. 14 illustrates an example lamp assembly having control circuitry which steers energy from an inductor of a power converter to a secondary lamp using the forward stroke of the inductor, in accordance with embodiments of the present disclosure.

FIG. 14 illustrates an example lamp assembly 732G having control circuitry 712G which steers energy from inductor 1402 of power converter 722 to secondary lamp 752 using the forward stroke of inductor 1402, in accordance with embodiments of the present disclosure. In this implementation, a flyback stroke of inductor 1402 may be used to generate a bias voltage in winding 1406 of inductor 1402 and the forward stroke may deliver power to secondary lamp 752 from winding 1406 if switch 1408 is enabled. When switch 1410 is enabled, windings 1404 and 1406 of inductor 1402 may be charged, and winding 1406 may discharge to secondary lamp 752 when switch 1408 is enabled. When switch 1410 is disabled, winding 1404 may discharge to main lamp 742. In addition, when switch 1410 is disabled, winding 1406 may discharge to voltage regulator 1412, in order to regenerate a voltage within lamp assembly 732G. Again, as in FIG. 13, such voltage regeneration using an auxiliary winding similar to winding 1406 is often common in existing lamp assemblies, and thus leveraging such auxiliary winding 1406 to provide energy to secondary lamp 752 may reduce cost and complexity of a design.

Figure 15:
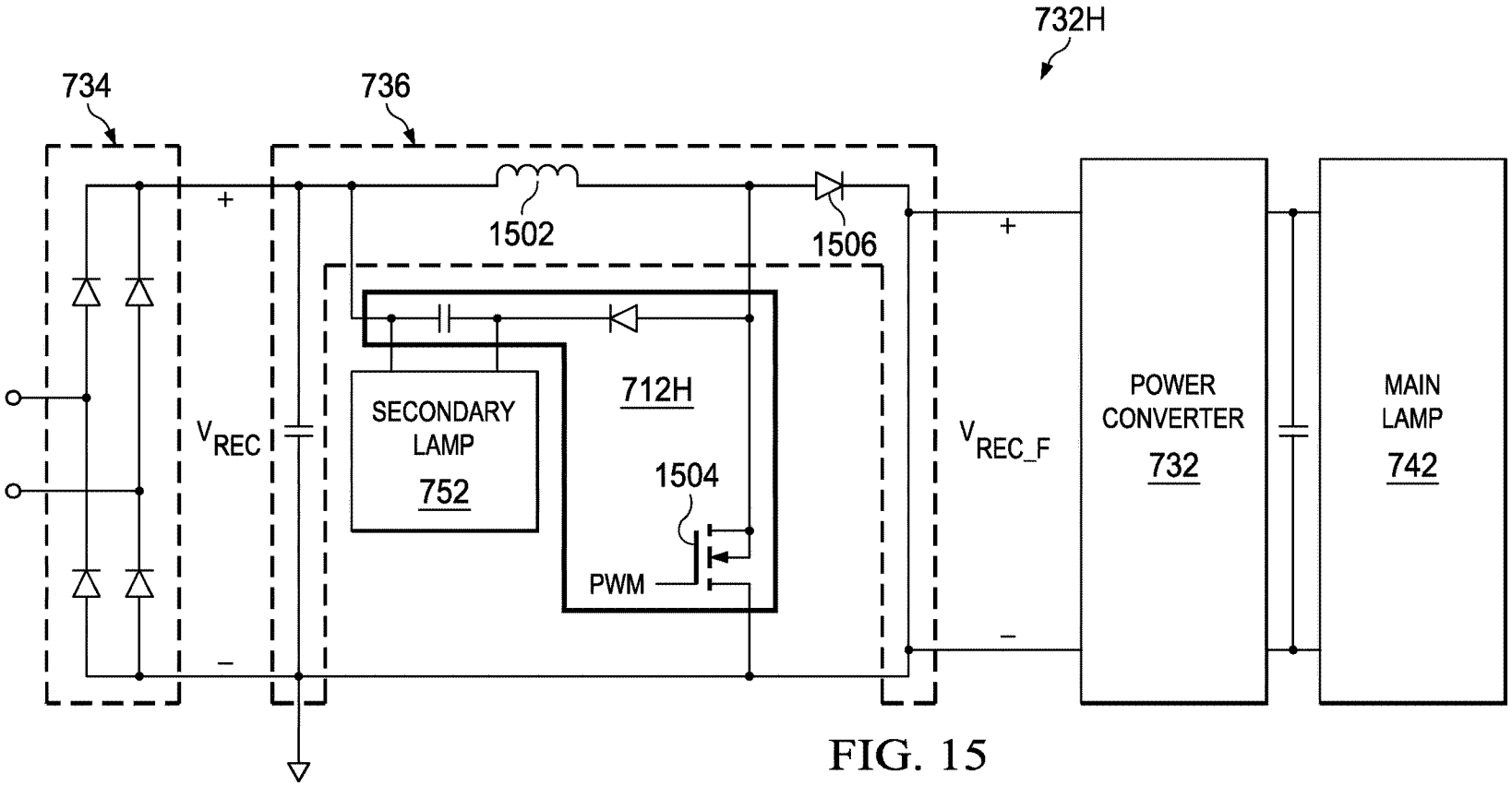
FIG. 15 illustrates an example lamp assembly having control circuitry with a buck-boost converter for controlling a secondary lamp, wherein the buck-boost converter leverages an inductor of an electromagnetic interference filter, in accordance with embodiments of the present disclosure.

FIG. 15 illustrates an example lamp assembly 732H having control circuitry 712H that leverages an inductor 1502 of EMI filter 736 in order to implement a buck-boost converter for controlling secondary lamp 752, in accordance with embodiments of the present disclosure. In operation, when switch 1504 is enabled, inductor 1502 may be charged. When switch 1504 is disabled, inductor 1502 delivers energy to secondary lamp 752. The buck-boost converter formed by inductor 1502 and control circuitry 712H may become active only when reactive dimmer energy, dimmer attach energy, or other energy needs to be handled, which will occur when rectified voltage $v_{REC}$ exceeds filtered rectified voltage $V_{REC_F}$.

Figure 16A:
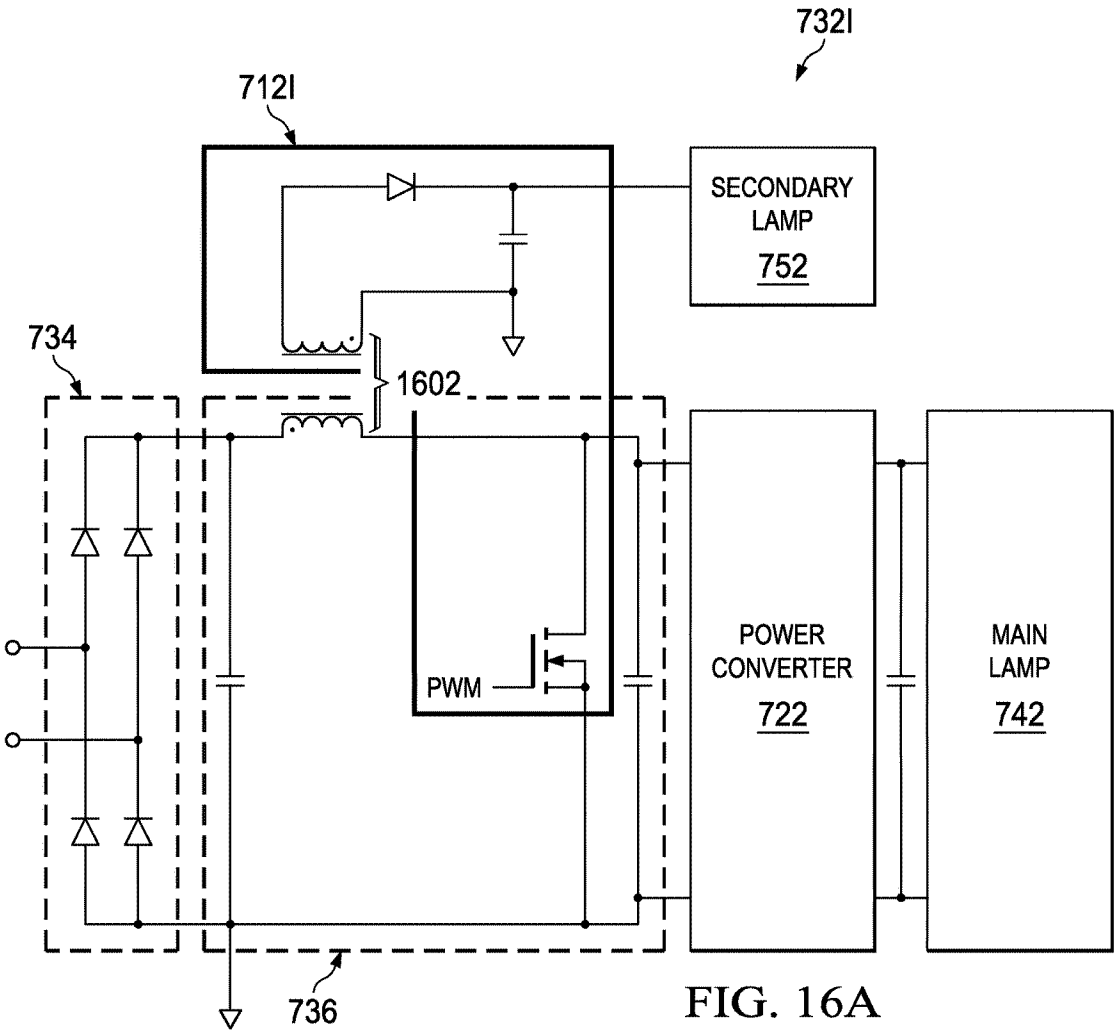
FIG. 16A illustrates an example lamp assembly having control circuitry with a buck-boost converter for controlling a secondary lamp using a flyback topology, wherein the buck-boost converter leverages an inductor of an electromagnetic interference filter, in accordance with embodiments of the present disclosure.
Figure 16B:
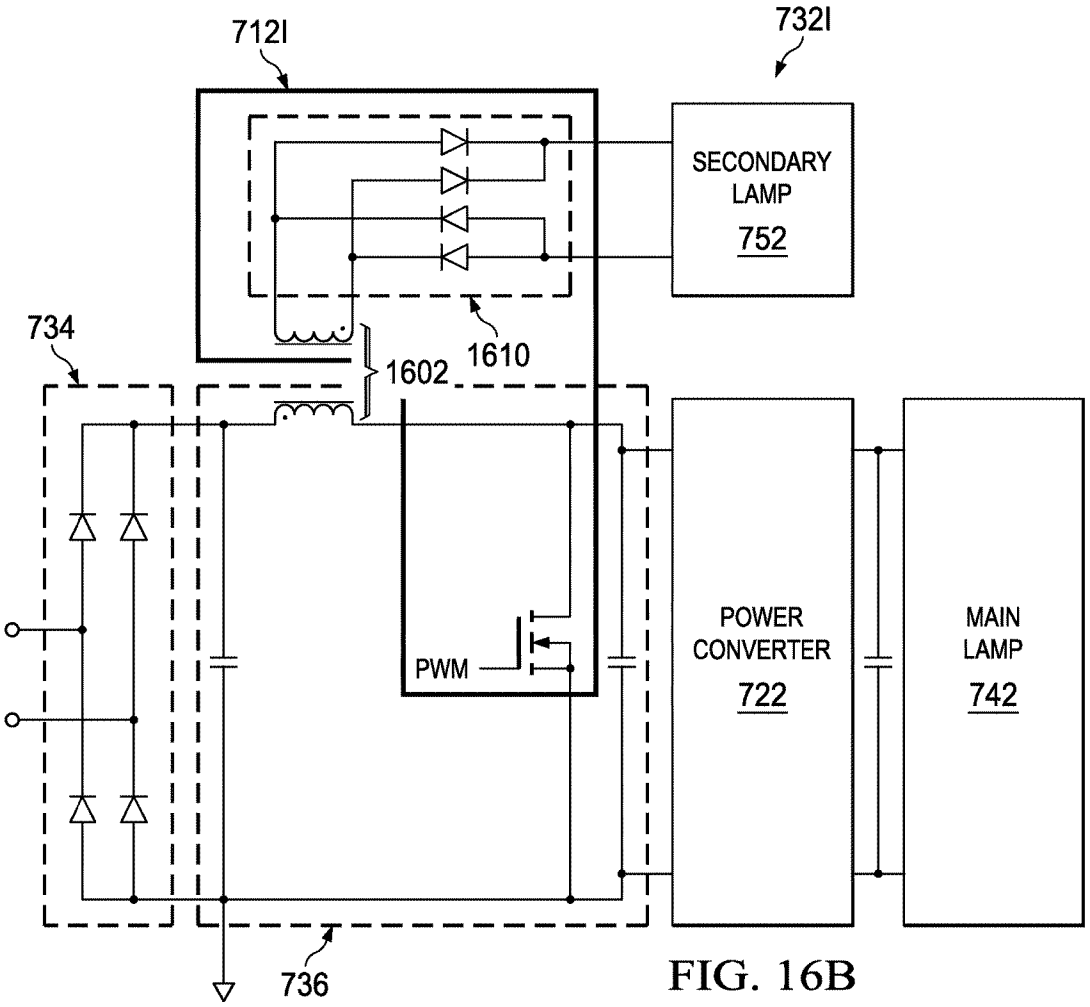
FIG. 16B illustrates another example lamp assembly having control circuitry with a buck-boost converter for controlling a secondary lamp using a flyback topology, wherein the buck-boost converter leverages an inductor of an electromagnetic interference filter, in accordance with embodiments of the present disclosure.

FIG. 16A illustrates an example lamp assembly 732I having control circuitry 712I that leverages an inductor 1602 of EMI filter 736 in order to implement a buck-boost converter for controlling secondary lamp 752, in accordance with embodiments of the present disclosure. Example lamp assembly 732I is identical to that of lamp assembly 732H, except that lamp assembly 732I utilizes a flyback topology. When the PWM signal is active (e.g., high), energy is stored in inductor 1602. When the PWM signal is inactive (e.g., low), the inductor discharges energy to secondary load 752. FIG. 16B illustrates an alternative implementation of control circuitry 712I in which a bridge rectifier 1610 is coupled between a winding of two-winding inductor 1602 and secondary lamp 752, rather than a single-diode rectifier, as shown in FIG. 16A.

Figure 17:
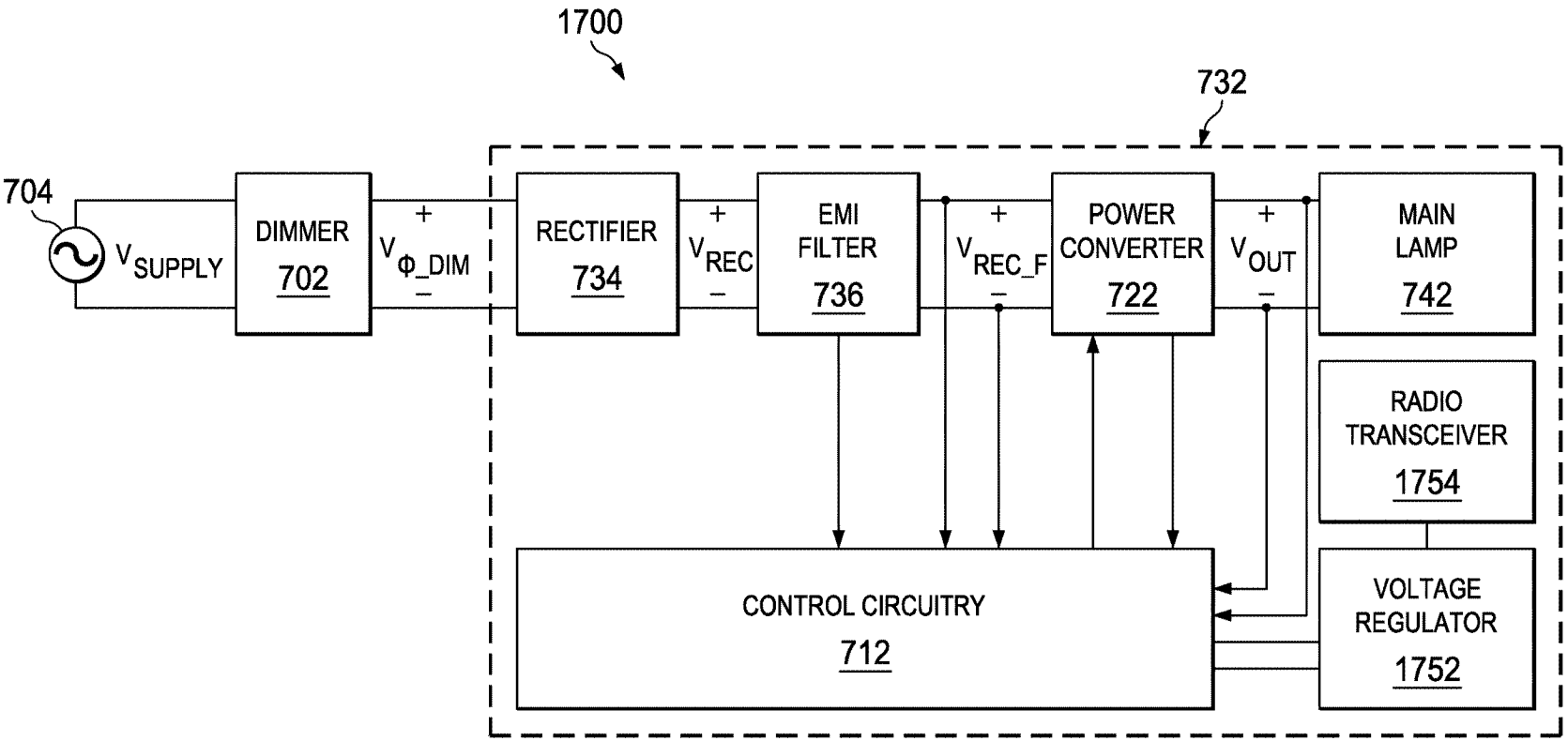
FIG. 17 illustrates another example lighting system including control circuitry for providing compatibility between a low-power lamp and other elements of a lighting system, in accordance with embodiments of the present disclosure.

FIG. 17 illustrates an example lighting system 1700 including control circuitry 712 for providing compatibility between a low-power lamp 742 and other elements of lighting system 1700, in accordance with embodiments of the present disclosure. FIG. 17 is identical to FIG. 7, except that secondary lamp 752 is replaced with voltage regulator 1752, and a radio transceiver 1754 is added to lighting system 1700. In some embodiments, reactive energy of dimmer 702, EMI filter 736, and/or other components of lighting system 1700 may be delivered to voltage regulator 1752, in addition or in lieu of a secondary lamp 752. In such embodiments, voltage regulator 1752 may be configured to supply electrical energy to a device present in lamp assembly 732. In some of such embodiments, such device to which such electrical energy is supplied may include a radio transceiver for communicating signals to and/or from lamp assembly 732.

As used herein, when two or more elements are referred to as "coupled" to one another, such term indicates that such two or more elements are in electronic communication whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. An apparatus comprising:

a control circuit for controlling delivery of energy from an input of a lamp assembly to a load of the lamp assembly, wherein the control circuit is configured to:

determine from an input signal on the input of the lamp assembly a control setting of a dimmer electrically coupled to the input;

transfer a first amount of energy from the input to the load to cause the load to generate light external to the lamp assembly in accordance with the control setting, wherein the control setting indicates a user-desired amount of energy to be transferred to the load; and transfer a second amount of energy from the input to a second load to cause the second load to dissipate the second amount of energy external to the lamp assembly, wherein the second amount of energy comprises reactive energy associated with the dimmer.

2. The apparatus of claim 1, wherein the second load comprises a lamp configured to generate visible light at a wavelength between approximately 570 nm and approximately 610 nm.

3. The apparatus of claim 2, wherein the lamp comprises a light-emitting diode.

4. The apparatus of claim 2, wherein the first load comprises another lamp configured to generate white light.

5. The apparatus of claim 4, wherein the first load has a power efficacy substantially higher than a power efficacy of the second load.

6. The apparatus of claim 1, wherein the second amount of energy comprises reactive energy associated with an electromagnetic interference filter integral to the lamp assembly.

7. A method for controlling delivery of energy from an input of a lamp assembly to a load of the lamp assembly, comprising:

determining from an input signal on the input of the lamp assembly a control setting of a dimmer electrically coupled to the input;

transferring a first amount of energy from the input to the load to cause the load to generate light external to the lamp assembly in accordance with the control setting, wherein the control setting indicates a user-desired amount of energy to be transferred to the load; and transferring a second amount of energy from the input to a second load to cause the second load to dissipate the second amount of energy external to the control circuit, wherein the second amount of energy comprises reactive energy associated with the dimmer.

8. The method of claim 7, wherein the second load comprises a lamp configured to generate visible light at a wavelength between approximately 570 nm and approximately 610 nm.

9. The method of claim 8, wherein the lamp comprises a light-emitting diode.

10. The method of claim 8, wherein the first load comprises another lamp configured to generate white light.

11. The method of claim 10, wherein the first load has a power efficacy substantially higher than a power efficacy of the second load.

12. The method of claim 7, wherein the second amount of energy comprises reactive energy associated with an electromagnetic interference filter integral to the lamp assembly.

* * * * *